US006229975B1

(12) United States Patent
Wilhelm et al.

(10) Patent No.: US 6,229,975 B1
(45) Date of Patent: May 8, 2001

(54) ELECTROPHOTOGRAPHIC APPARATUS HAVING A DEVICE FOR TONER DELIVERY

(75) Inventors: Blasius Wilhelm, Neusaess; Georg Boehmer; Karl-Heinz Jenak, both of Munich; Joseph Knott, Tutzing; Peter Bremmer, Roehrmoos, all of (DE)

(73) Assignee: Øcé Printing Systems GmbH, Poing (DE)

( * ) Notice: Subject to any disclaimer, the term of this patent is extended or adjusted under 35 U.S.C. 154(b) by 0 days.

(21) Appl. No.: 09/284,560

(22) PCT Filed: Oct. 15, 1997

(86) PCT No.: PCT/DE97/02386

§ 371 Date: Jul. 16, 1999

§ 102(e) Date: Jul. 16, 1999

(87) PCT Pub. No.: WO98/16877

PCT Pub. Date: Apr. 23, 1998

(30) Foreign Application Priority Data

Oct. 15, 1996 (DE) ..... 196 42 570

(51) Int. Cl.[7] ..... G03G 15/08

(52) U.S. Cl. ..... 399/258; 399/25; 399/120

(58) Field of Search ..... 399/13, 24, 98, 399/120, 224, 256, 258, 259, 262

(56) References Cited

U.S. PATENT DOCUMENTS

| | | | |
|---|---|---|---|
| 4,833,501 | 5/1989 | Büyükgüclü . | |
| 4,945,956 | 8/1990 | Bueyuekgueclue | 141/67 |
| 4,967,234 | 10/1990 | Tani et al. . | |
| 5,074,342 | 12/1991 | Kraehn | 141/65 |
| 5,329,340 | 7/1994 | Fukuchi et al. . | |

FOREIGN PATENT DOCUMENTS

| | | |
|---|---|---|
| 33 43 910 | 6/1984 | (DE) . |
| 35 12 060 | 10/1985 | (DE) . |
| 35 31 775 | 3/1986 | (DE) . |
| 0 308 431 | 3/1990 | (EP) . |
| 59-22069 | 2/1984 | (JP) . |
| 61-166565 | 7/1986 | (JP) . |
| 62-98374 | 5/1987 | (JP) . |
| 4-182678 | 6/1992 | (JP) . |
| 5-45955 | 2/1993 | (JP) . |
| 5-188779 | 7/1993 | (JP) . |
| 8-152751 | 6/1996 | (JP) . |
| WO 95/10074 | 4/1995 | (WO) . |

*Primary Examiner*—Arthur T. Grimley
*Assistant Examiner*—Hoang Ngo
(74) *Attorney, Agent, or Firm*—Schiff Hardin & Waite

(57) ABSTRACT

An apparatus for electrophotographic production of images on a printing medium, such as a printer or copier, has a printing unit fed with toner from a toner storage tank. Toner can be refilled into the tank through a closable opening without interrupting the printing operation.

27 Claims, 18 Drawing Sheets

| F | M | CONDITIONS |
|---|---|---|
| 0 | 0 | Z1 |
| 0 | 1 | Z2 |
| 1 | 0 | Z3 |
| 1 | 1 | Z4 |

*FIG. 19*

ELECTROPHOTOGRAPHIC APPARATUS HAVING A DEVICE FOR TONER DELIVERY

BACKGROUND OF THE INVENTION

The invention is directed to an apparatus for the electrophotographic production of image patterns on a recording medium, particularly or printer or copier, comprising at least one printing unit to which toner is supplied from a toner reservoir. According to various inventive aspects, the invention is directed to devices for delivering the toner and/or for eliminating the toner in such an apparatus.

When the toner supply in the toner reservoir has just about run out, a signal is produced in a known printer that causes the printer to be arrested or stopped. An operator must then replenish toner from a standardized refilling container into the toner reservoir. After the end of the filling procedure, printing operations can be reassumed. The similar case is true for handling used toner that is collected by a cleaning station in the printer or copier. When a used toner container has reached a high filling level, an operator is informed of this by an alarm signal. The printing operations are interrupted and the full used toner container is replaced with an empty one. The described procedure reduces the availability, economic feasibility and user-friendliness of the printer or, respectively, copier. This is particularly felt given high-performance printers that should print or, respectively, copy optimally free of interruptions in order to achieve their full efficiency.

U.S. Pat. NO. 4,967,234 discloses a copier device whose device covers, for example device doors, are connected to an electrical safety means. When the device doors are opened, the copier device is turned off by this safety means. An opening that is not connected to the safety means is incorporated into the device covering. A toner container with fresh toner can be supplied to the copier device via this opening. The fresh toner is refilled into a container. The toner container emptied in this way is then filled with used toner.

U.S. Pat. No. 5,329,340 discloses an apparatus for the electrophotographic generation of image patterns on a recording medium. The apparatus contains two toner reservoirs. When the first toner reservoir is empty, a switch is made to the second toner reservoir. The used toner that arises is collected in a used toner container. When the used toner container is not available, the used toner is collected in an additionally provided container inside the apparatus or outside the apparatus.

WO-A-95 10074 discloses a color printer with a developing unit. Toner from a toner reservoir is supplied to this developing unit with a delivery conduit and a pump.

SUMMARY OF THE INVENTION

An object of the invention is to specify an apparatus for the electrographic production of image patterns on a recording medium, whereby the apparatus operation is possibly optimally continuous. In particular, it is an object of the invention to enable a toner delivery without interrupting the apparatus operations.

This object is achieved by an improvement in an apparatus for electrographically producing image patterns on a recording medium, such as a printer or copier, which apparatus comprises at least one printing unit to which toner is supplied from a toner reservoir that is essentially permanently installed within the apparatus and can be refilled at chronological intervals via a filling opening, an apparatus cover for covering internal parts of the apparatus as well as the toner reservoir, an electrical safety means that interrupts operation of the apparatus when the apparatus cover is opened, and an opening provided in the apparatus cover through which the toner reservoir can be refilled from the outside without interrupting the printing process. The improved apparatus has means for generating or creating a slight under-pressure or vacuum in the toner reservoir at least during a reflecting procedure.

Exemplary embodiments of the invention are explained below with reference to the drawing. Further features of various inventive aspects, advantageous effects and the combination of features of the invention are referred to in this explanation.

BRIEF DESCRIPTION OF THE DRAWINGS

FIG. 19 is a diagram directed to the definition of various operating container.

DESCRIPTION OF THE PREFERRED EMBODIMENTS

Figure 1:
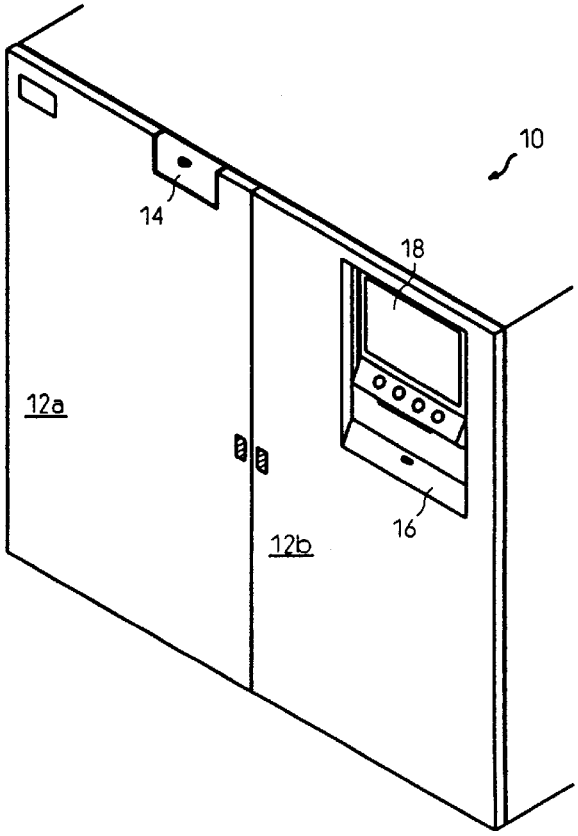
FIG. 1 is a front view of a high-performance printer with closed flaps.

FIG. 1 schematically shows the front side of a high-performance printer 10 that can print single sheets at high speed. The high-performance printer 10 contains two printing units (not shown) to each of which a respective toner reservoir is allocated, and toner is supplied to the respective printing units from each of these reservoirs. The toner reservoirs are essentially permanently installed in the high-performance printer 10 and must be refilled via a filling opening 20 at chronological intervals dependent on the use. The two apparatus doors 12*a*, 12*b* pivotable toward the outside serve the purpose of covering internal parts of the high-performance printer 10 as well as of the toner reservoir. The device doors 12*a*, 12*b* are connected to an electrical security means that interrupts the operation of the high-performance printer and 12*b* are in an open condition. In order to avoid such an interruption and nonetheless enable a refilling with toner, an opening 20 respectively closeable by flaps 14, 16 that are not connected to the security system is provided in the region of each of the two toner reservoirs. A control panel 18 that, as shall be described later, can be pivoted out is arranged above the flap 16.

Figure 2:
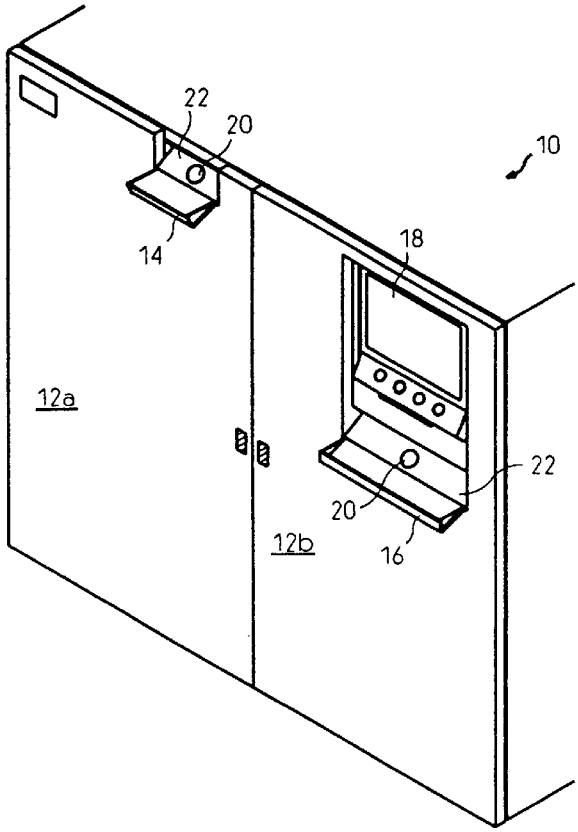
FIG. 2 is a front view of FIG. 1 with opened flaps.

FIG. 2 shows the front view of the high-performance printer 10 of FIG. 1 with opened flaps 14, 16. In the opened condition of the flaps, the filling openings 20 of the toner reservoirs 22 become visible. Toner from a standardized refilling bottle can thus be refilled into the toner reservoirs 22 without opening the apparatus door 12*a*, 12*b* and interrupting the printing operations. In the closed condition of the flaps 14, 16, the internal parts of the high-performance printer 10 are again completely protected against the outside world.

Figure 3:
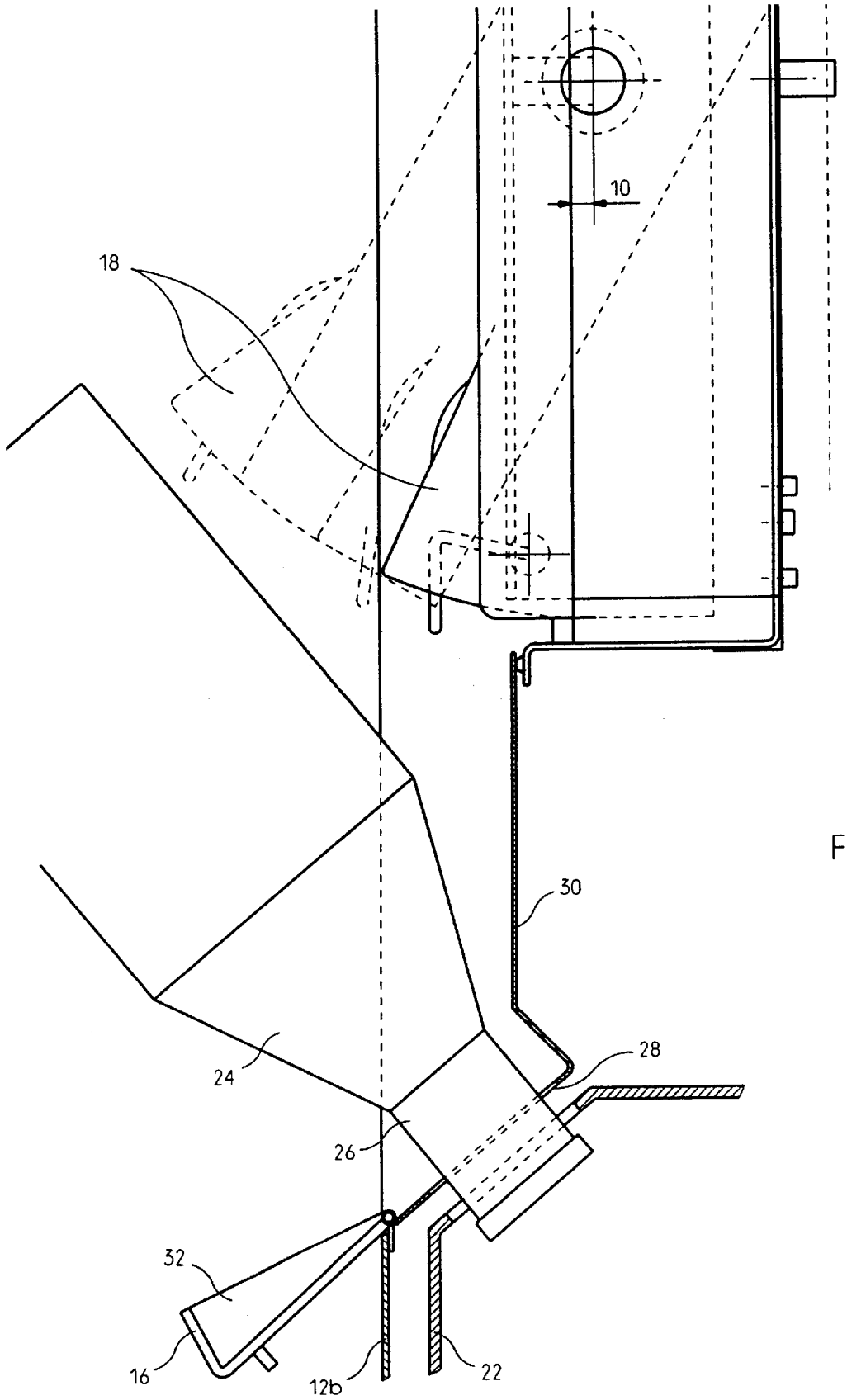
FIG. 3 is a schematic view when refilling the toner reservoir.

FIG. 3 shows the condition when refilling with a standardized toner refilling bottle 24. The refilling bottle 24 has its bottle neck 26 introduced in an oblique attitude through an opening 28 in the metal paneling 30 and into an opening of the toner reservoir 22 to fill this reservoir with toner. After the filling, the flap 16 closes the opening 28.

The flap 16 is shaped such that it defines an upwardly opened container space 32. This container space 32 serves the purpose of collecting toner that may potentially be spilled during filling. The access to the toner reservoir 22 for the refilling bottle 24 is fashioned such that a spilling of toner when placing the refilling bottle 24 can be easily avoided and the emptying of the refilling bottle 24 can ensue unproblemmatically on the basis of gravity due to its oblique attitude.

It can be seen in the upper part of the FIG. that the control panel 18 can be pivoted. The filling opening of the toner reservoir 22 is fashioned so that, when refilling with the standardized refilling bottle 24, this can be introduced with play at the swivelled-out control panel 18.

Figure 4:
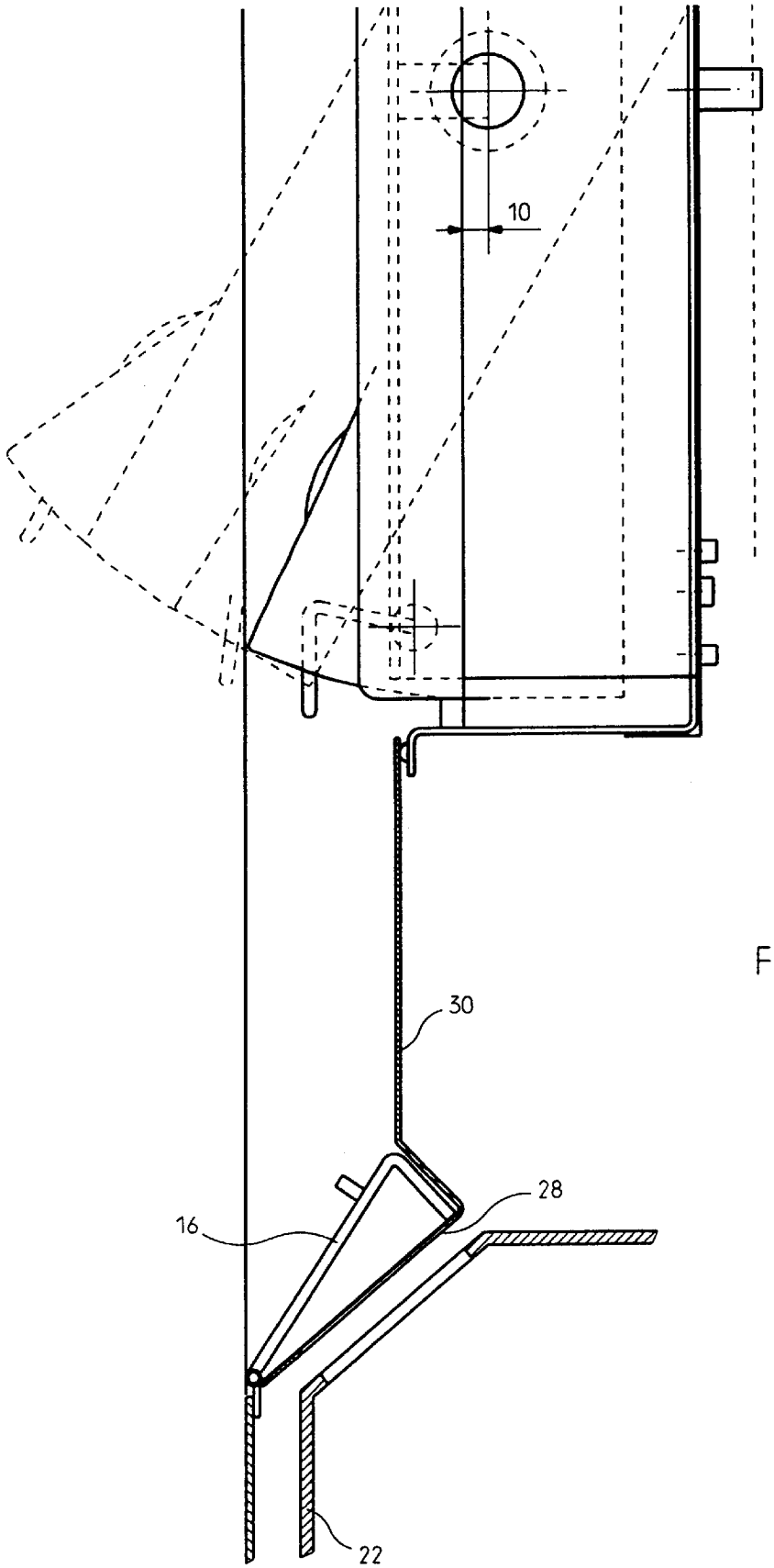
FIG. 4 is a view of FIG. 3 with closed flaps.

To facilitate an understanding, FIG. 4 shows the flap 16 in the closed condition wherein the opening 28 is completely covered.

Figure 5:
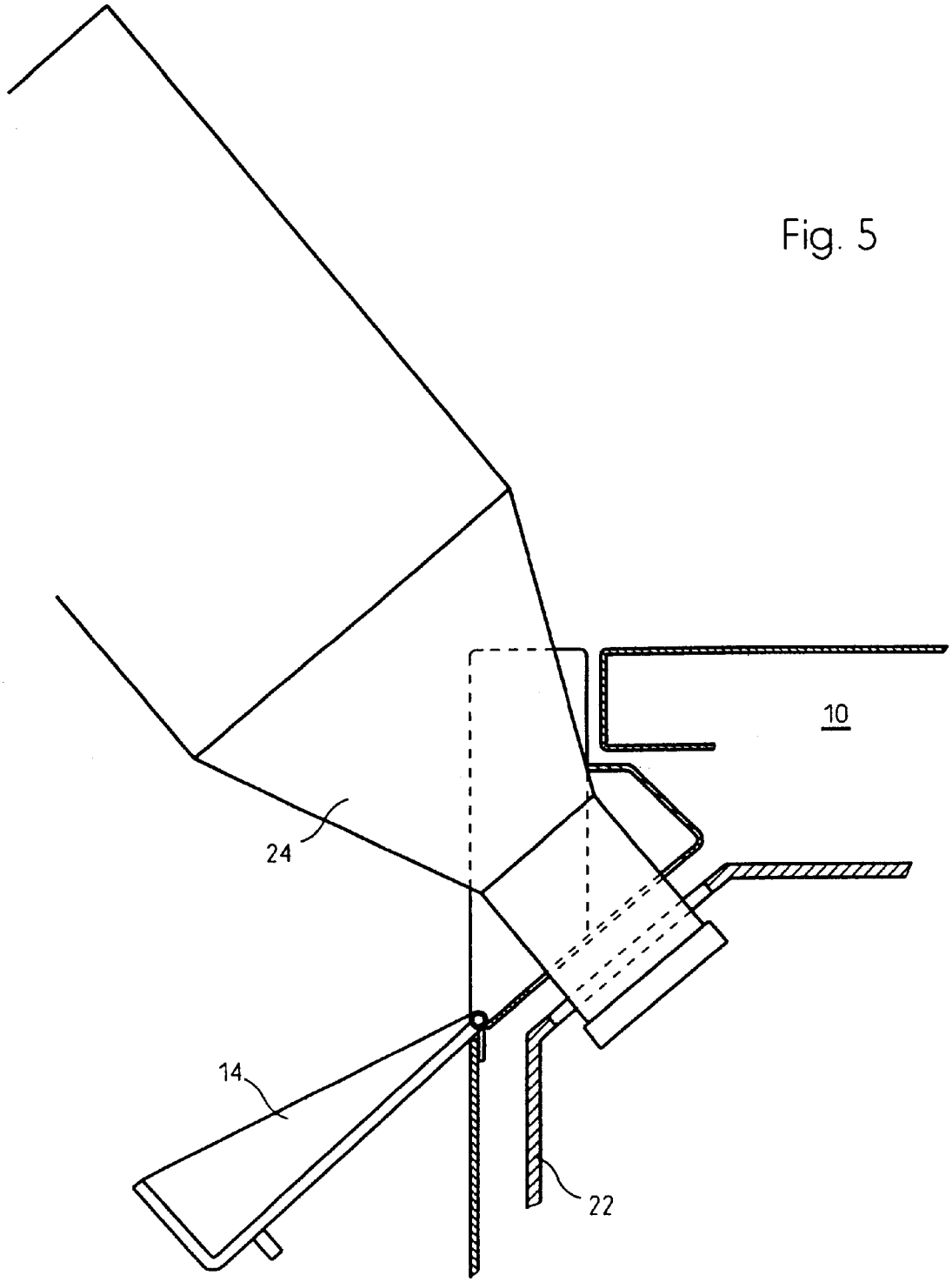
FIG. 5 is a schematic view with a flap in the proximity of the upper edge of the printer in the condition wherein the refilling bottle is introduced.
Figure 6:
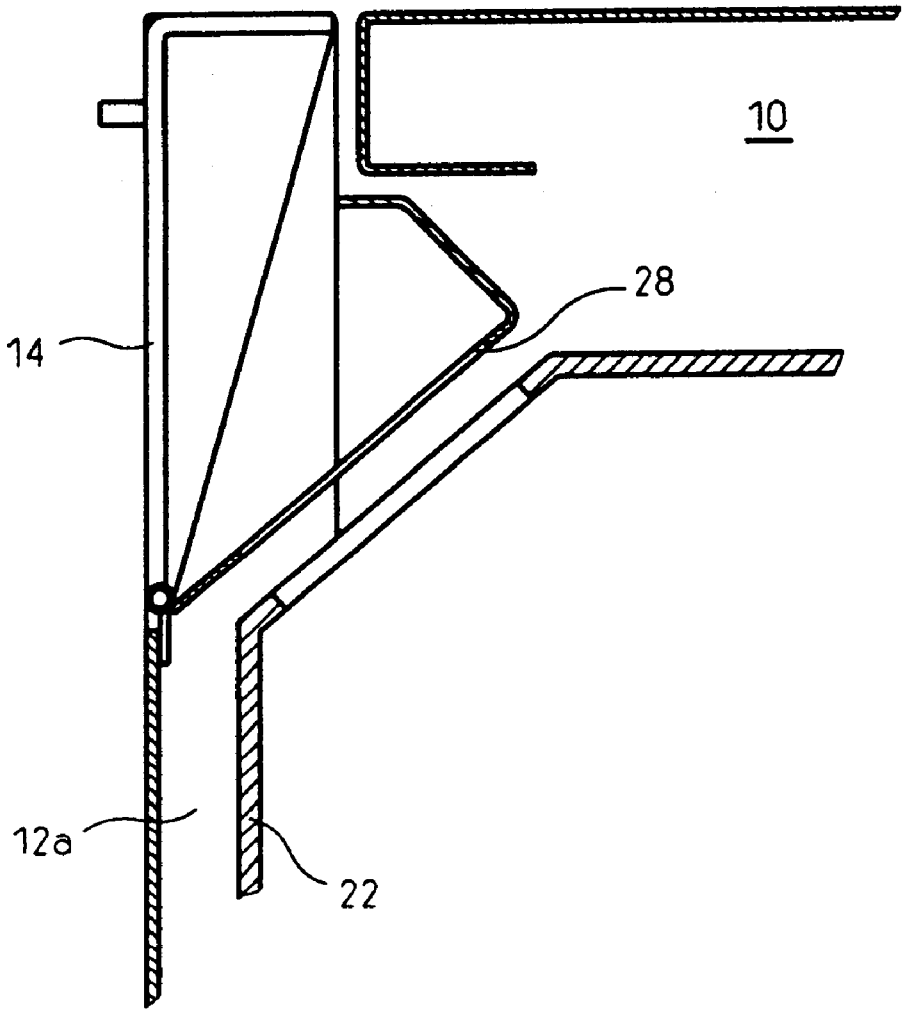
FIG. 6 is a schematic view with the upper flap of FIG. 5 in its closed condition.

FIG. 5 shows another exemplary embodiment wherein the flap 14 is arranged in the upper edge region of the paneling of the high-performance printer 10. According to FIG. 6, it can be seen that the cuboid-shaped housing form is again completed with the closed condition of the flap 14.

Figure 7:
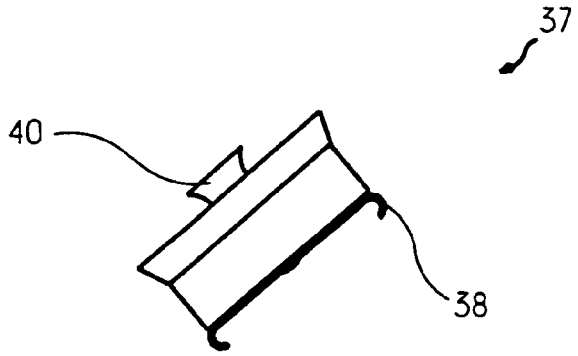
FIG. 7 is a schematic view of the toner reservoir with a cap removed from a mouthpiece.
Figure 7:
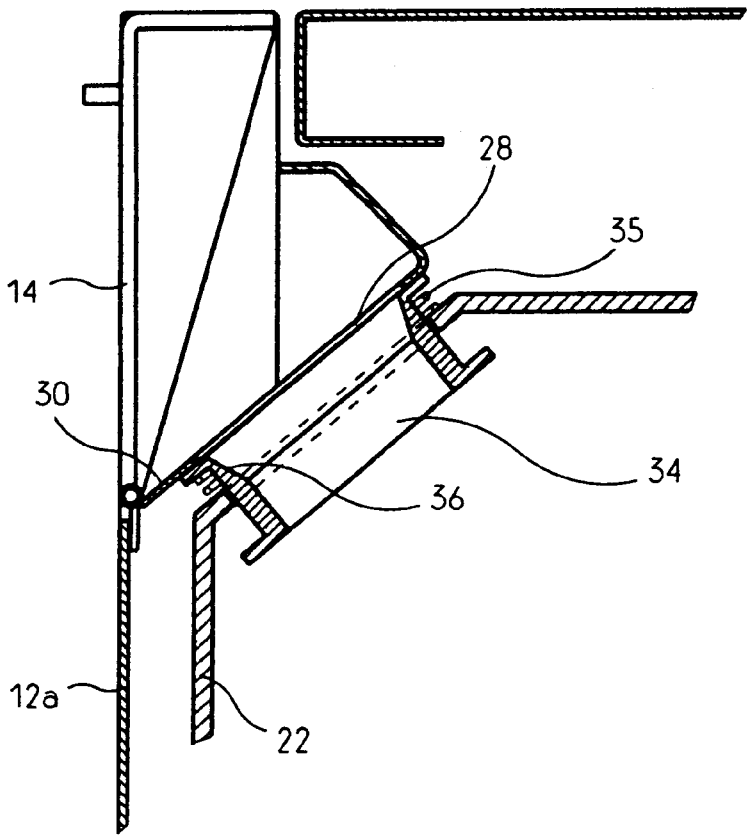

The toner reservoir 22 is shown as a partial excerpt in FIG. 7. The toner reservoir 22 holds the contents of two refilling bottles each respectively having 0.6 kg of toner. Accordingly, the toner reservoir 22 has a receptacle volume of approximately 3.6 liters, whereby the cone arising during the filling procedure is to be taken into consideration in the design of the toner reservoir 22 as an additionally required space. A mouthpiece 34 that is fixed by a spring element 35 is introduced into the toner reservoir 22. The mouthpiece 34 has a funnel-shaped section 36 that assures that an optimally small annular gap arises between the opening of the mouthpiece 34 and the refilling bottle. The center axis of the opening of the mouthpiece 34 proceeds obliquely relative to the vertical, so that the refilling bottle can be attached in an oblique attitude and spilling of toner is avoided. The center axis of the opening of the mouthpiece 34 intersects, roughly, the center axis of the toner reservoir 22, this assuring that the cone is built up in the middle of the toner reservoir 22. The opening of the mouthpiece 34 is closed tight with a closure cover 37 after the refilling. The closure cover 37 has a spring snap 38 at its underside with which it engages into the mouthpiece 34 with a snap-in event after being introduced. The closure cover 37 has a handle 40 at its upper side.

Figure 8:
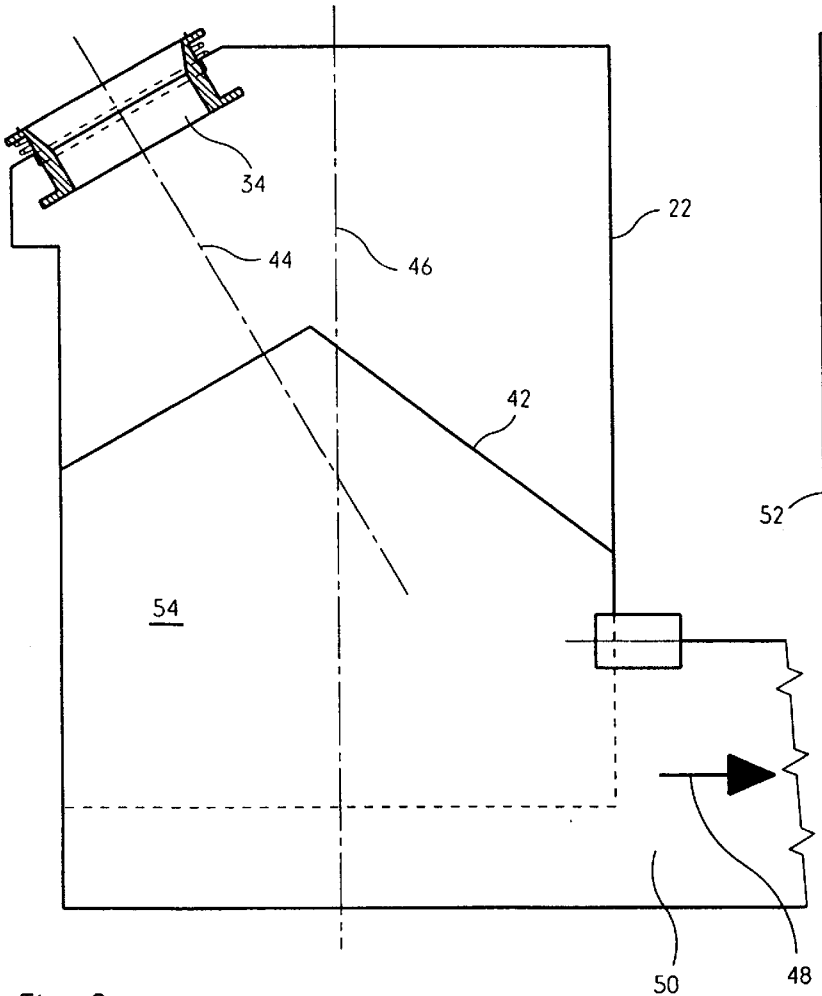
FIG. 8 is a side view of the toner reservoir.

FIG. 8 schematically shows the structure of the toner reservoir 22 viewed from the side. The center axis 44 of the mouthpiece 34 intersects the center axis 46 of the toner reservoir at roughly mid-height. A channel 50 via which toner 54 is conveyed off to the printing unit in the direction of the arrow 48 is located in the lower region of the toner reservoir.

Figure 9:
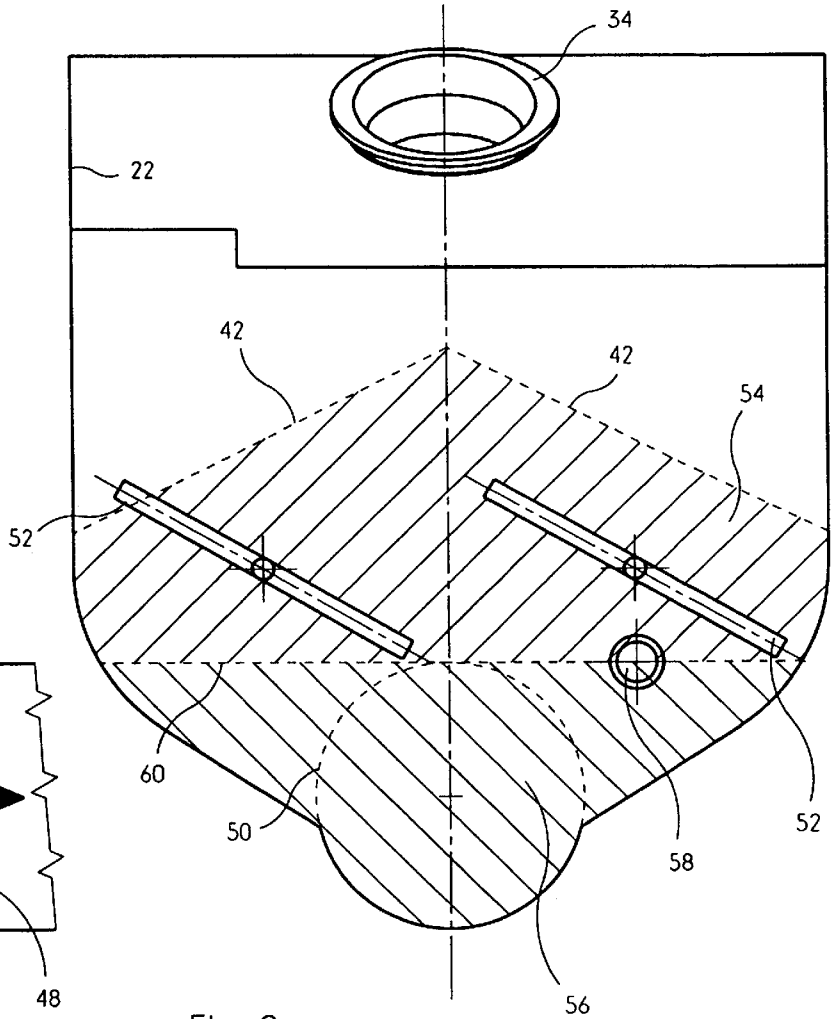
FIG. 9 is a view of the toner reservoir from the front.

FIG. 9 shows a view from the front. The mouthpiece 34 is located in the middle of the toner reservoir 22, as a result whereof a uniform delivery and an optimum, uniform emptying of the toner reservoir 22 being assured. A filling level sensor 58 outputs an alarm signal when the toner 54 has reached the level 60 (hatched line). The remaining amount 56 is then still adequate in order to enable a refilling of the toner without an interruption of the printing having to ensue. Two pivot arms 52 that rotate oppositely relative to one another see to it that toner adhering to the inside wall of the toner reservoir 22 is scraped off and a dense bulk cone 42 arises.

Figure 10:
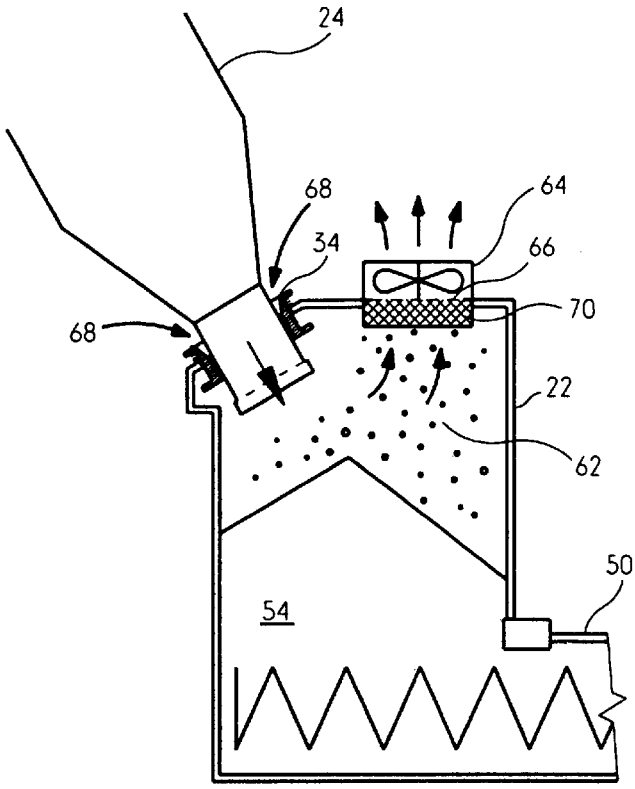
FIG. 10 for the generation of an under-pressure in the toner reservoir.
Figure 11:
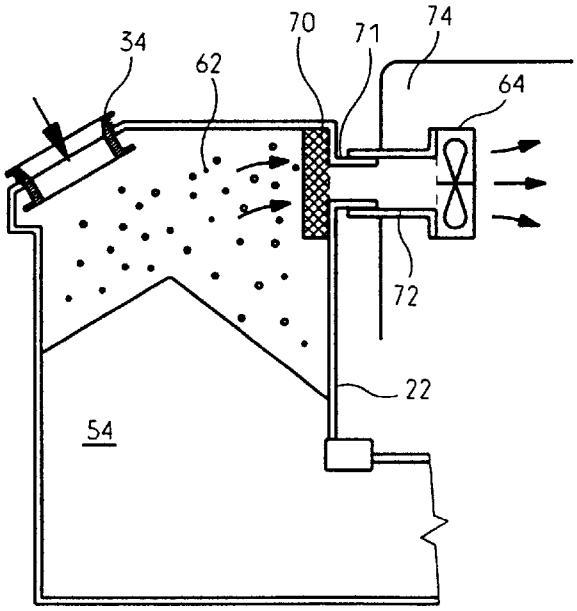
FIG. 11 is a schematic view of the connection of a connecting hose.
Figure 12:
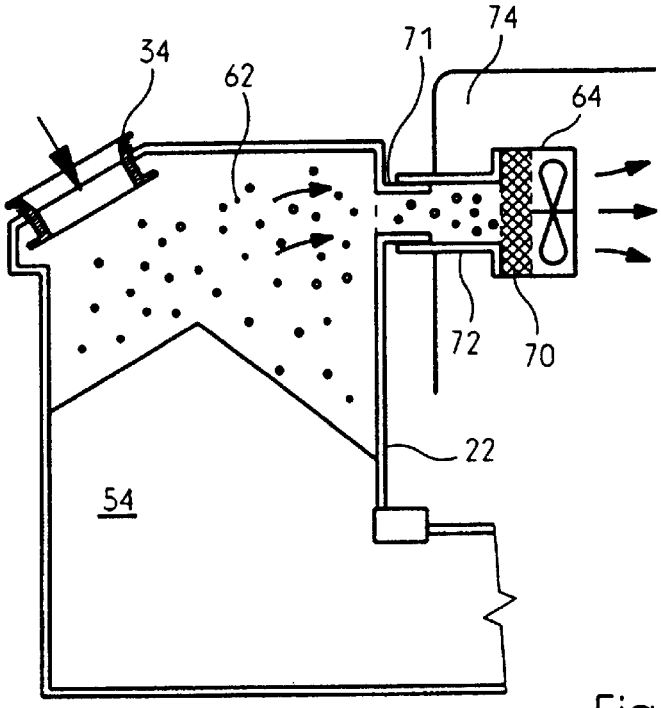
FIG. 12 is a schematic view of the arrangement of a filter outside the toner reservoir.

FIGS. 10, 11 and 12 are directed to a further aspect of the invention according to which a slight or vacuum is generated in the toner reservoir. FIG. 10 illustrates the refilling of the toner reservoir 22. Toner dust 62 that can also emerge from the annular gap opening at the mouthpiece 34 without further measures arises when refilling toner from the refilling bottle 24. Inventively, air is extracted from the toner reservoir 22 via an air discharge opening 66 by a ventilator or fan 64 at least during the filling process, as a result whereof air is suctioned through the annular gap at the bottle neck in the direction of the arrows 68. Toner dust 62 cannot emerge. The air outlet opening 66 is provided according to FIG. 10 with a filter 70 at the inside of the toner reservoir 22 and, this filter 70 retains toner. The air outlet opening 66 is arranged in the upper region of the toner reservoir 22, preferably in the toner-free area.

FIG. 11 shows an alternative embodiment. A discharge nozzle 71 is connected to a connecting hoses 72 that leads into the inside 74 of the printer. In this version, the ventilator 64 is arranged in the interior 74 of the printer. FIG. 12 shows a development of the arrangement according to FIG. 11. In this development, the filter 70 is arranged in the interior 74 of the printer and not in the toner reservoir 22.

During operation of the printer, a control sees to it that the under-pressure is built up in the toner reservoir 22 no later than at the beginning of the toner refilling procedure; this under-pressure must be maintained until the end of the refilling procedure. For example, the start of the extraction can ensue with an electromechanical switch that is actuated when the toner reservoir 22 is opened. It is also possible to maintain the under-pressure in the toner reservoir 22 during the entire operation of the printer.

Figure 13:
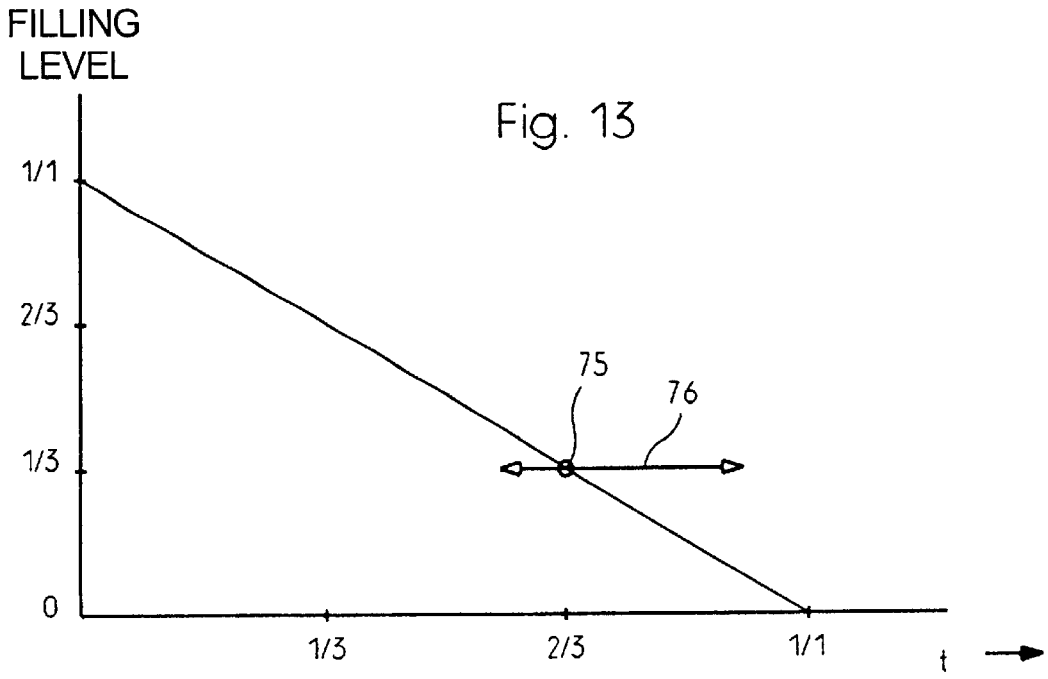
FIG. 13 is a diagram of the decrease of the amount of toner over the operating time.

FIG. 13 shows a diagram with reference whereto the drop of the toner filling level in the toner reservoir 22 over the operating time of the printer is illustrated. The operating time is shown on the abscissa; the toner filling level is shown on the ordinate. The toner filling level 75 at which the filling level sensor 58 outputs an alarm signal is entered in the characteristic. This alarm signal means that the toner will soon run out and toner must be refilled. An operator must refill toner within the remaining time wherein adequate toner is still present in order to maintain printer operations. The position of the filling level sensor 58 can be modified, as a result whereof the range of remaining time shown by an arrow 76 within which the refilling can ensue without interrupting printing can be set. The alarm signal is preferably output when the filling level lies at 10–40% of the overall amount of toner in the toner reservoir 22. When the remaining toner is used, then the control must generate an abort signal with which the printer operation is shut off. In addition to producing an abort signal after the lapse of a predetermined time, it can also be generated dependent on the consumption of the remaining toner. For example, the use of toner can be identified on the basis of a toner mark control in combination with a clocked toner replenishment. Given this toner marked control, a control pulse for a toner replenishment is output for a dosing shaft controlled step-by-step at every toner mark on the photoconductor drum of the printing unit that is inked too lightly. The time for a toner replenishment, i.e. for a specific toner amount, can be set in defined fashioned per control pulse. When the remaining amount of toner is used after the occurrence of the alarm signal can be identified from the addition of the conveying times and the dosing quantity per time unit. The abort signal can be accordingly generated. In this way, the overall time within which a refilling of toner must ensue can be optimally defined in order to maintain operations free of printing interruptions.

Another possibility of identifying the toner consumption and generating the abort signal is by determining the use of toner based on the printed picture elements and the printing contrast that has been set. Of course, it is also possible to define a specific number of pages that are still allowed to be printed after the occurrence of the alarm signal until the abort signal is generated. What is thereby disadvantageous is that the remaining time for the refilling can be extremely short since the toner consumption is highly dependent on the degree to which the printed pages are blackened.

It is also possible to continuously identify the actual filling level in the toner reservoir 22 on the basis of the current consumption of toner and the amount of replenished toner after the occurrence of the alarm signal. This actual filling level can then be displayed at the printer on a display. The level at which the filling level sensor 58 outputs its alarm signal then serves as measuring point for the actual toner filling level in the toner reservoir 22.

Figure 14:
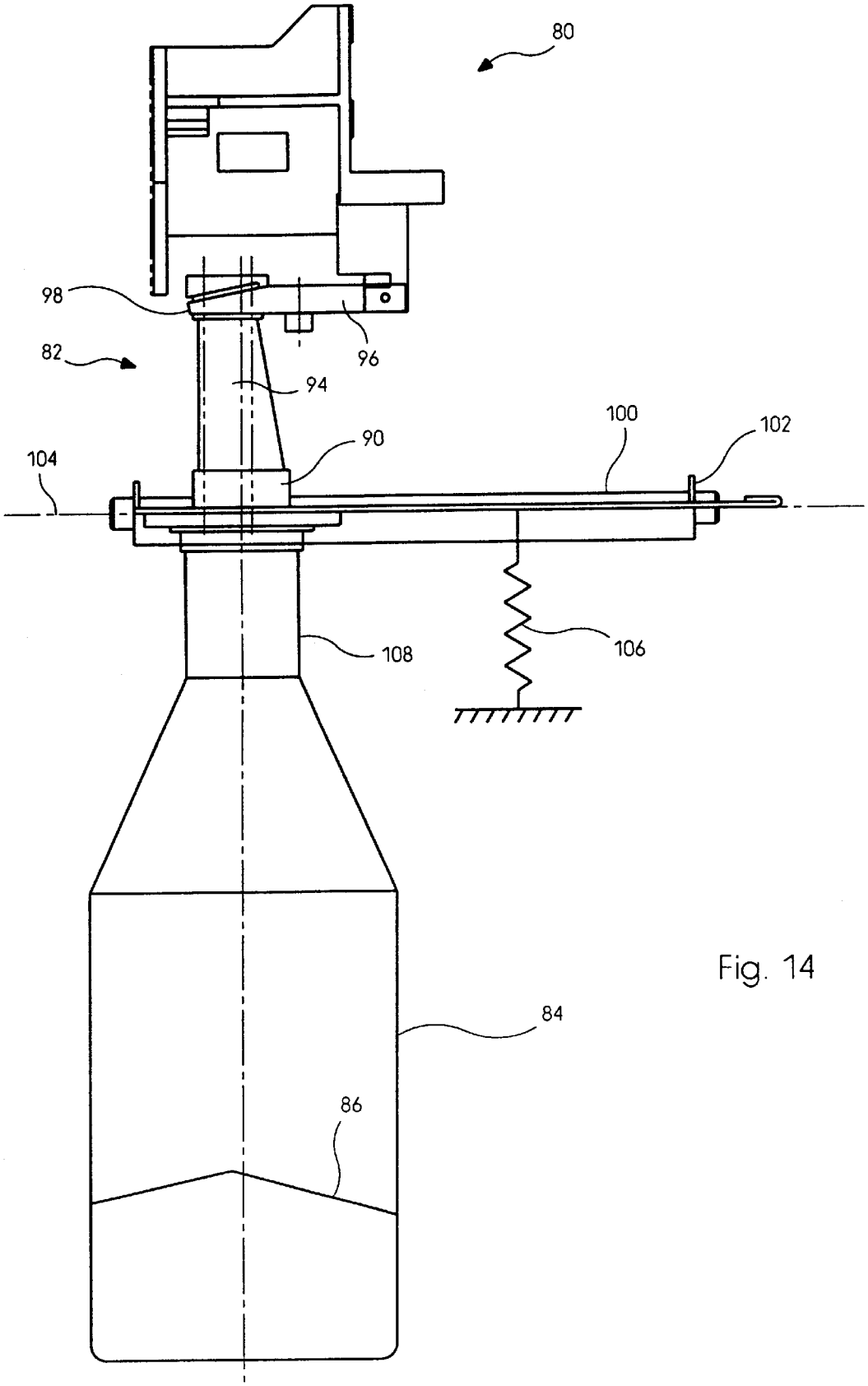
FIG. 14 is a schematic side view of the adapter unit connected to a used toner container.

The following FIGS. 14 through 22 refer to devices for discharging used toner that is collected by the cleaning system in the printing unit. FIG. 14 schematically shows the elimination of the used toner output by the cleaning station 80 via an adapter unit 82 into a used toner container 84. When the fill level 86 in the used toner container 84 has reached a specific height, the used toner container 84 must be replaced with an empty one. In order to enable this in a simple way, the used toner container 84 is not connected directly to the cleaning station 80; rather, the adapter unit 82 is provided as a connecting member, which assures that the toner does not adhere to it or collect either due to its cohesion forces or due to the residual electrical charge, which can potentially lead to a blockage.

Figure 15C:
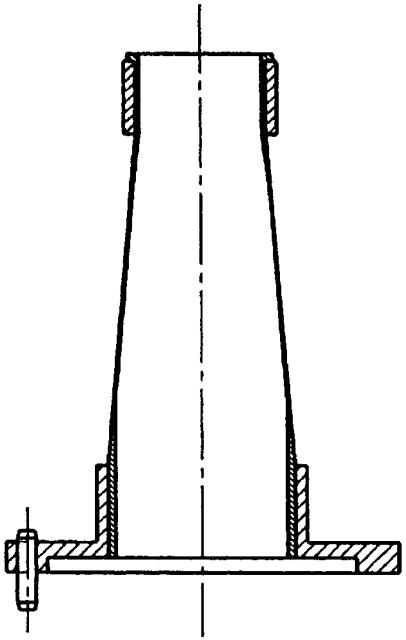
FIGS. 15A, 15B and 15C are different vies of an adapter unit with FIG. 15A being a side view, FIG. 15B being a top plan view and FIG. 15C being a cross-sectional view.
Figure 15B:
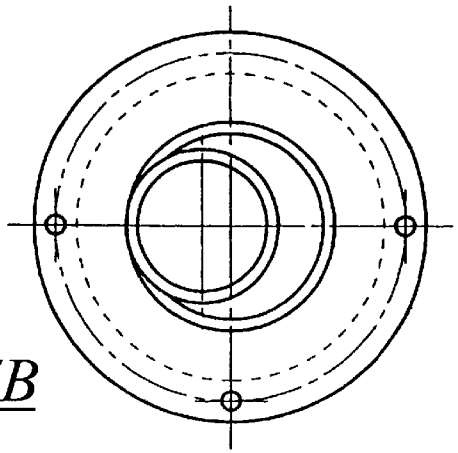
Figure 15A:
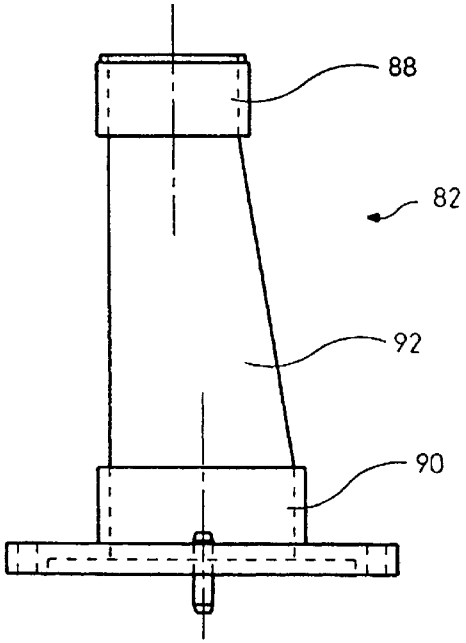

FIGS. 15A, 15B and 15C show the structure of the adapter unit 82 in a side view, a plan view and in a lateral cross-section. At the side of the cleaning unit 20, the adapter unit 82 has a stable collar 88 that is fashioned as a rotary part. A further rotary part 90 that, as shall be explained later, is accepted in a locking plate is provided at the side of the used toner container 84. A flexible hose 92 is arranged between the collar 88 and the rotary part 90. This hose 92 is composed of silicone-containing plastic and is vulcanized into the parts 88, 90. Due to the flexibility of the hose 92, a horizontal compensation of design tolerances can ensue on the one hand; on the other hand, this hose 92 can execute vertical motions and deformation without retaining a deformation. The hose 92 expands in the direction toward the used toner container in the fashion of an explainding conical frustum. As a result thereof, a permanent collection of used toner in the hose 92 is avoided.

Figure 16A:
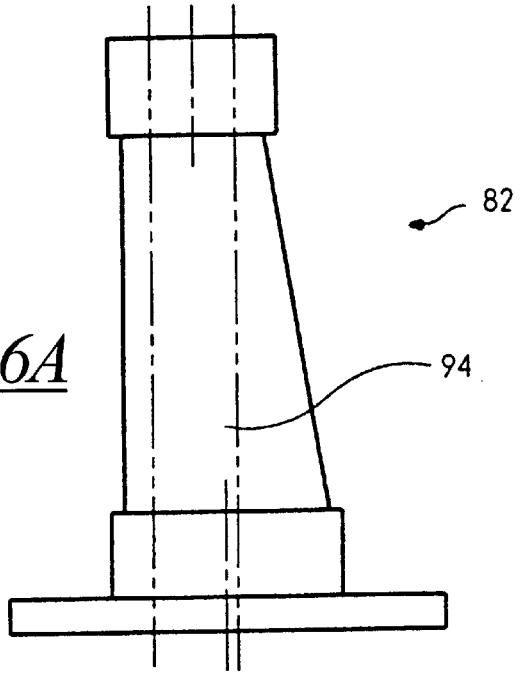
FIG. 16A is a side view of the adapter in a relaxed state.
Figure 16B:
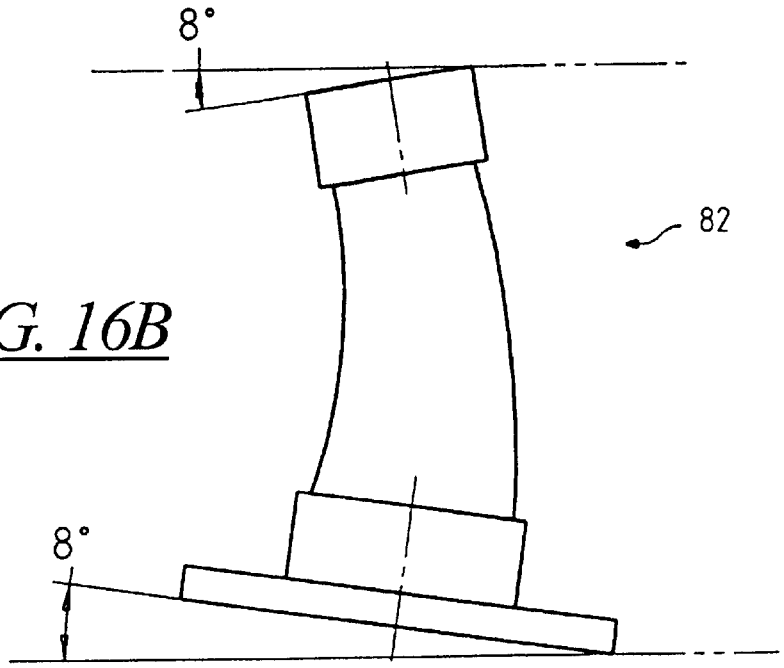
FIG. 16B is a side view of the adapter in a compressed state.

FIG. 16B illustrates the flexibility of the adapter unit 82, whereby it can execute an angular motion of approximately 8° at both ends independently of one another. The principal descending channel 94 in which the used toner overcomes a drop distance of approximately 100 mm without a clumping of the used toner or an adhesion to the inside ensuing is entered with dash-double dot lines in FIG. 16A.

Returning to FIG. 14, it can be seen that the adapter unit 82 is connected to a swivel arm 96 of the cleaning unit 80 by a clamped connection 98. The rotary part 90 is accepted in a recess of a locking plate 100 that is seated in a peg 102 to rotate in a plane 104 that resides perpendicular to the paper plane. The locking plate 100 is pre-stressed in the direction of the used toner container 84 with a tension spring 106.

Figure 17:
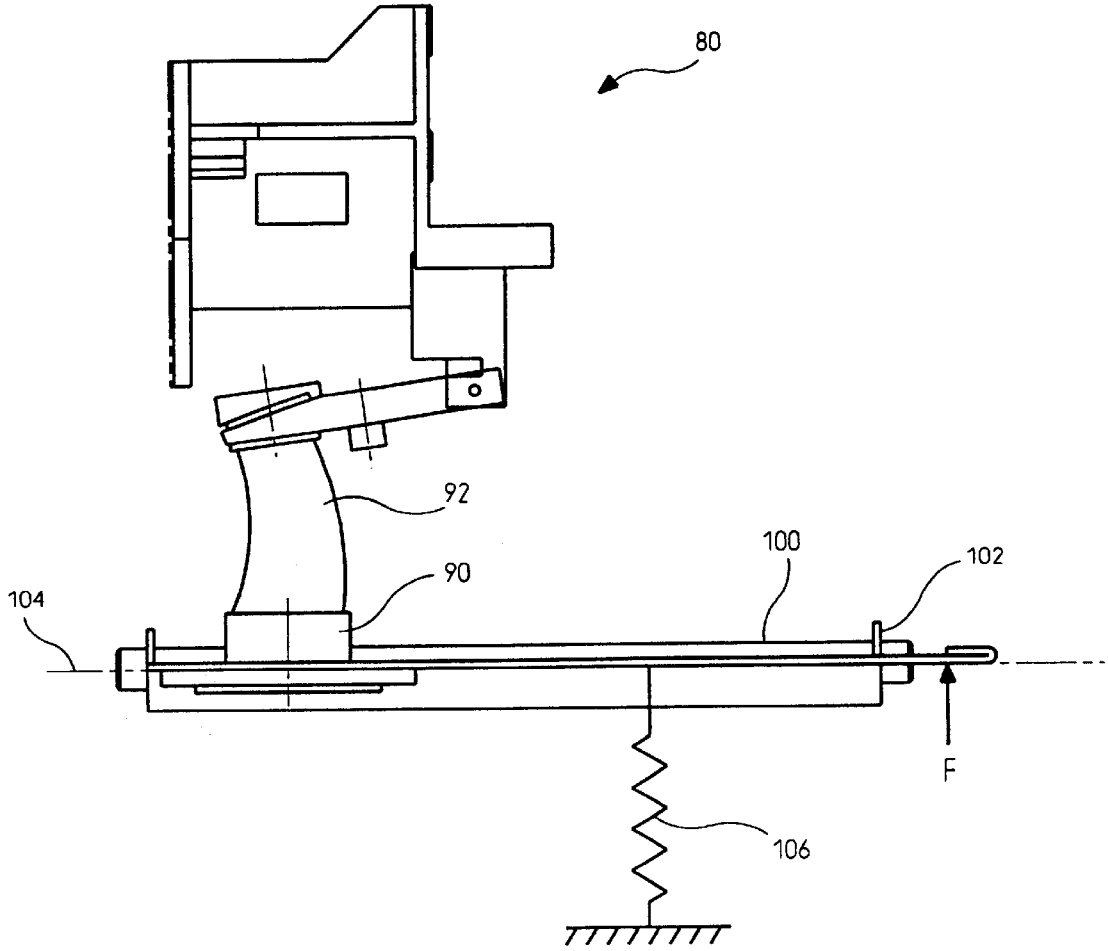
FIG. 17 is a side view of the adapter unit when replacing the used toner container.

FIG. 17 shows the adapter unit 82 and the locking plate 100 when replacing the used toner container (not shown in FIG. 17). For unlocking, the locking plate 100 is pressed up upon exertion of a force F of approximately 15 N, whereby the rotary part 90 has its inner surface releasing from the neck 108 (FIG. 14) of the used toner container 84 while compressing the hose 92. In this condition, the used toner container 84 can be moved out, as explained in greater detail in the following FIG. 18.

Figure 18:
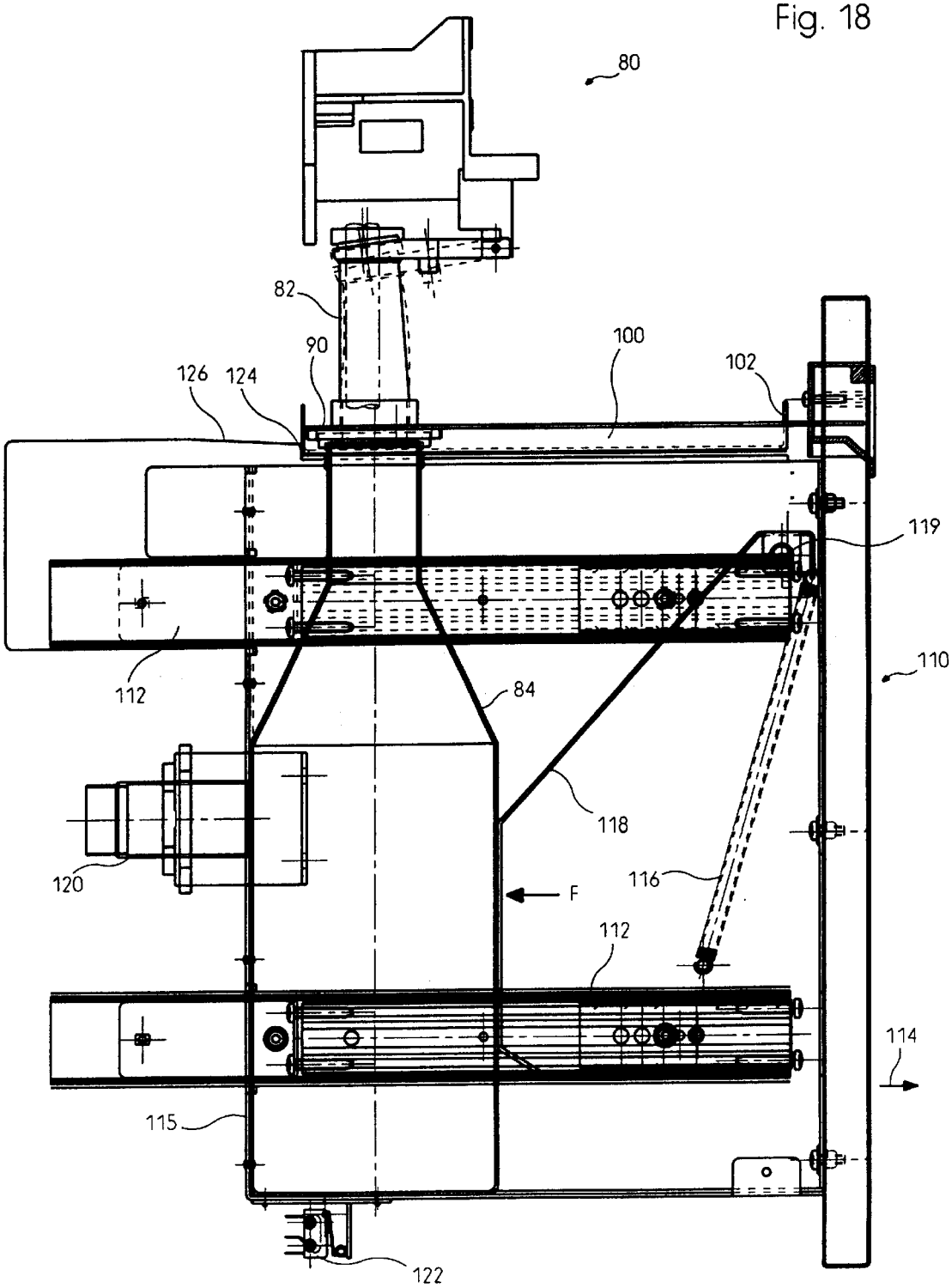
FIG. 18 is a side view of the used toner container inserted into a drawer.
Figure 20B:
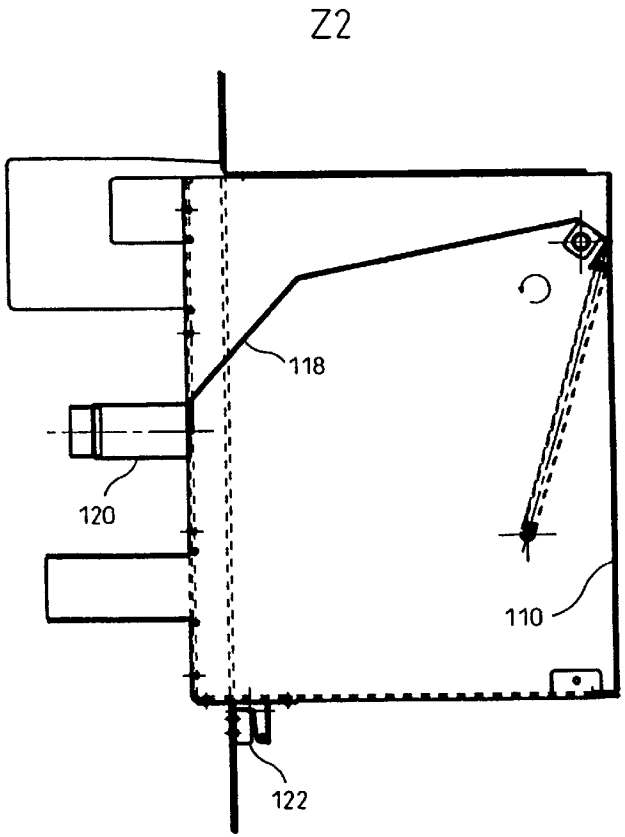
FIG. 20B is a schematic view of the drawer with the used toner container removed to illustrate the condition Z2.
Figure 20A:
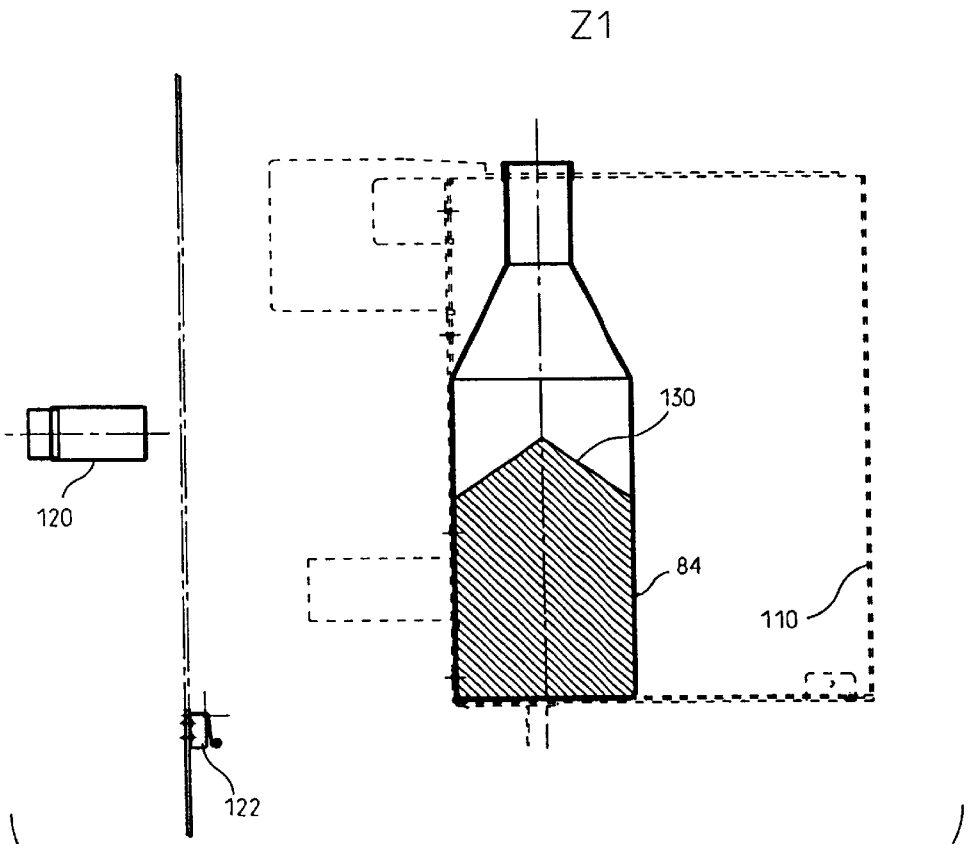
FIG. 20A is a schematic view of the drawer with a full, used toner container in an opened position to illustrate the condition Z1.

FIG. 18 shows a side view of the used toner container 84 introduced into a drawer 110. The operating status wherein used toner is conducted into the used toner container 84 is shown. The drawer 110 is seated on telescoping rails 112 and can be pushed out in the direction of the arrow 114 in order to replace the used toner container 84. The used toner container 84 is pressed against the back wall 115 of the door 110 with the force F by a swivel element 118 formed of sheet metal and is thus pressed against the acquisition surface of a capacitative filling level sensor 120. The force F is derived from a tension spring 116. The swivel element 118 is pivotably seated around a pivot bearing 119. A micro-switch 122 acquires the position of the drawer 110. Its signal is evaluated for monitoring, as shall be explained in greater detail later.

In the illustrated, introduced condition of the drawer 110, the locking plate 100 engages into a stop edge 124 of a lateral panel of the drawer 110. For changing the used toner container 84, the locking plate 100, as mentioned, is raised and pivoted out perpendicular to the paper plane, so tat the adapter unit 82 separates from the used toner container 84. A ramp 126 serves the purpose that the adapter unit 82 remains in a compressed condition in the withdrawn condition of the drawer 110. The hose 92 is bent off once or repeatedly in this hinged-up position and thereby seals the adapter unit with respect to the used toner. Toner particles cannot escape from the adapter unit in this condition; after the drawer has been withdrawn by about 300 mm, the full used toner container 84 can be replaced with an empty one. The new used toner container is pressed against the filling level sensor 120 by the swivel element 118, so that a stable operating position is achieved. Subsequently, the drawer 110 is again closed, this being signaled by the micro-switch 122. The locking plate 100 thereby lowers, the bend or, respectively, bends in the hose 92 are undone and used toner can again emerge from the adapter unit 82 into the used toner container 84. A further micro-switch 200 detects the raised or, respectively lowered position of the locking plate.

The micro-switch 122, the filling level sensor 120 and the micro-switch 200 are employed for signaling and for monitoring the various operating conditions when replacing the used toner container free of printing interruptions. The various operating conditions Z1through Z4 are shown in FIG. 19 dependent on the signals of the two detectors 120 and 122. The filling level sensor 120 has a signal status F=0 when the used toner container 84 has a high filling level. It has the value F=1 when the filling level is low. The micro-switch 122 has the value M=0 when the drawer 110 is pulled out; it has the value M=1 when the drawer is completely pushed in. The signal of the micro-switch 200 is employed to check the respectively proper position of the locking plate 100, for example whether the locking plate is lowered, after the drawer was pushed back in. A determination can be made with this information as to whether a toner transport from the adapter unit 82 through the hose 92 is possible. When a specific quantity of toner has arisen, then it must be assured that this can be disposed of from the adapter unit 82 into the used toner container.

The statuses Z1 through Z4 are defined according to the aforementioned signal statuses F and M. These various operating conditions Z1 through Z4 are graphically shown in FIGS. 20A, 20B, 21A and 21B. In condition Z1 (FIG. 20A, left), the drawer 110 is withdrawn and the used toner level 130 is high, i.e. the used toner container should be replaced. In this operation condition, the used toner container 84 must be replaced within a predetermined changing time; otherwise, the control generates an abort signal and printing operations are suspended. Instead of the changing time, the amount of used toner that has actually arisen can also be evaluated, for example by determining the plurality of printed picture elements and the contrast thereby set or by determining the amount of conveyed toner.

In the condition Z2, the swivel element 118 pivoted against the filling level sensor 120 simulates a full used toner container. The drawer 110 is closed and the micro-switch 122 is actuated. When no used toner container is introduced within a predetermined given this operating condition, then printing operations are suspended.

Figure 21B:
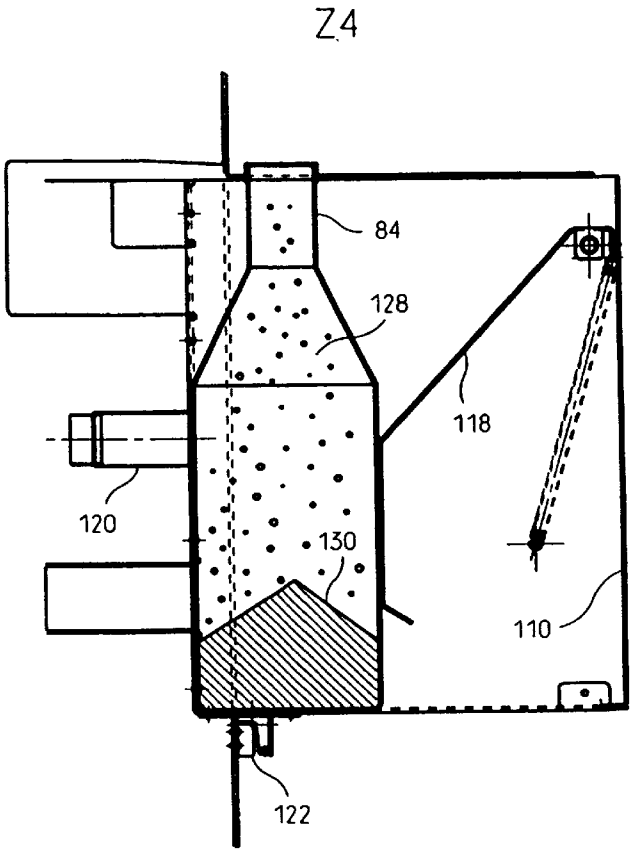
FIG. 21B is a schematic view of the drawer in a closed position and the container no yet full to illustrate the condition Z4.
Figure 21A:
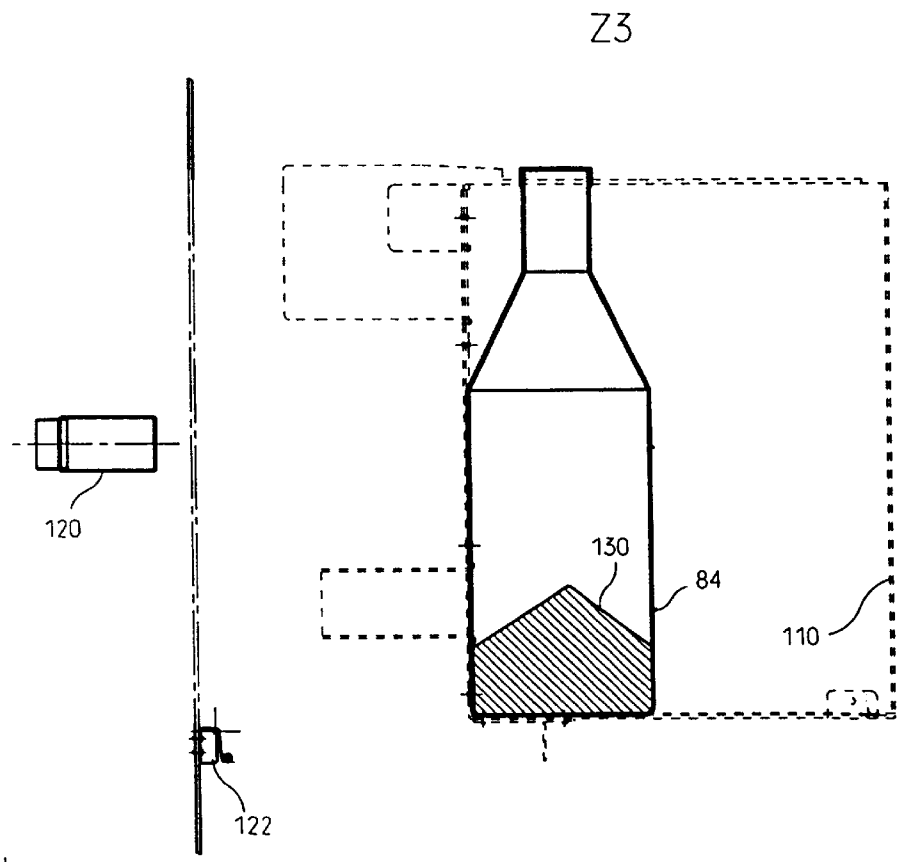
FIG. 21A is a schematic view of the drawer with a partially filled, used toner container in the opened condition to illustrate the condition Z3.

In the operating condition Z3 according to FIG. 21A, the drawer 110 is opened and the filling level sensor 120 indicates that the used toner level 130 still lies below the full level. When the drawer is not closed within a predetermined time in this operating condition, then printing operations are suspended.

The operating condition Z4 defines the printer operation without malfunction. The drawer 110 is closed and the capacitative filling level sensor 120 indicates that the used toner level 130 is low and the used toner container 84 can still accept an adequate quantity of used toner.

By evaluating the signal statuses F and M of the sensors 120 and 122, the control of the printer can reliably control the printer operation and monitor the replacement of the used toner container free of printing interruptions in all operating conditions.

Figure 22:
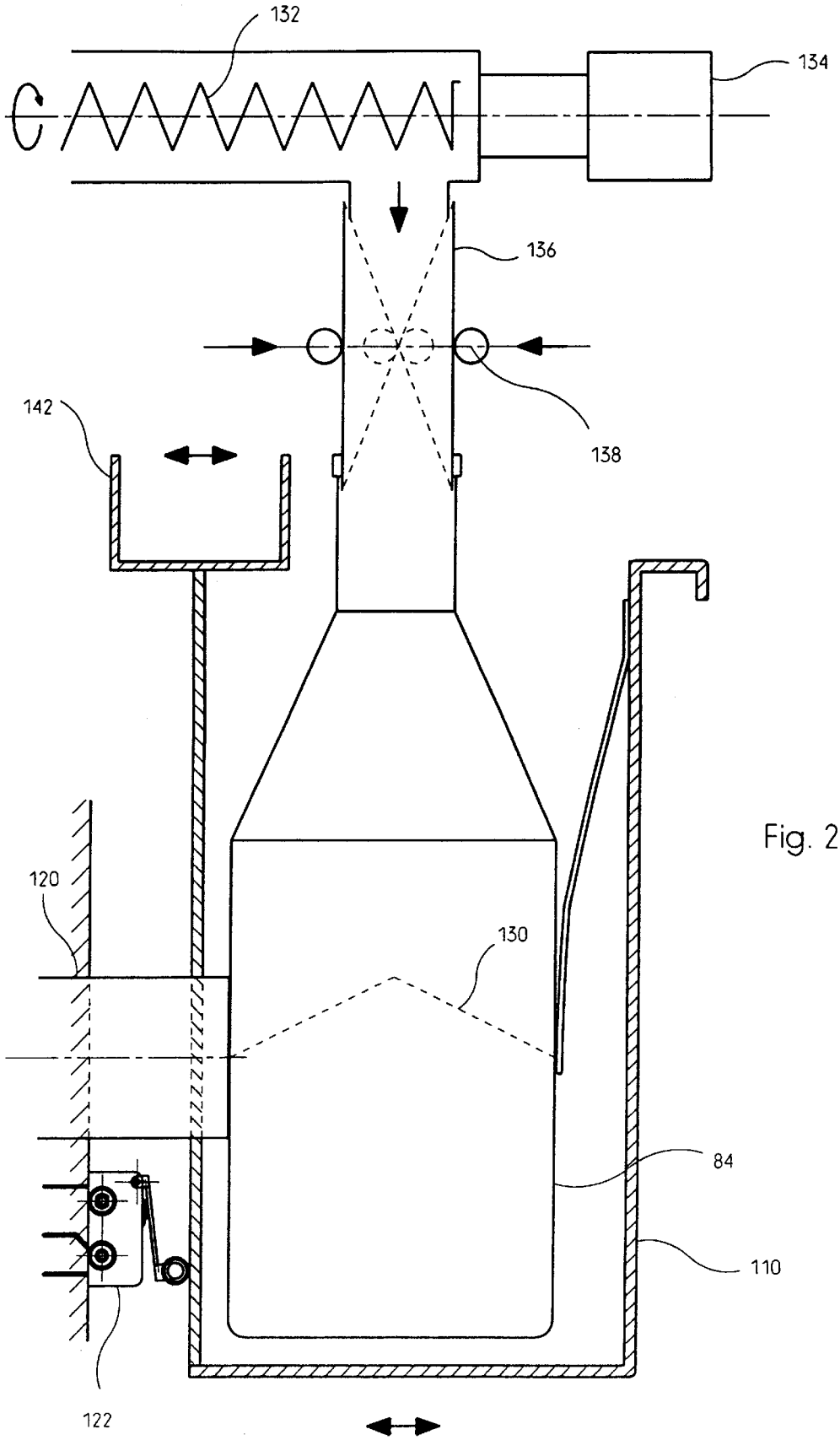
FIG. 22 further exemplary embodiments of a replacement of the used toner container without interrupting printing operations.

FIG. 22 shows further possibilities for the replacement of the used toner container without having to interrupt printing operations. What is critical for the replacement of the used toner container free of printing operations is that the filling level sensor 120 outputs a full signal in a condition when adequate space is still present for toner and there is still enough time in order to undertake steps for the replacement of the used toner container 84. When the time remaining until the full condition of the used toner container 84 is exceeded, then the control must immediately arrest printing operations in order to prevent an over-filling of the used toner container 84 and a possible toner jam. The remaining time can be identified on the basis of printed pages or the time can be defined dependent on the occurrence of used toner. The used toner occurrence derives from the transfer printing efficiency and can be exactly determined, for example, on the basis of the printed picture elements in combination with the transfer printing efficiency and the printing contrast, being identified by the control. In this version, the time until the replacement of the used toner container has been completed is maximum.

In order to be able to undertake the replacement of the used toner container during ongoing printing operations, the used toner that occurs must be collected in the interim. Various measures are shown in FIG. 22 as alternative or combined possibilities. The used toner conveyed by a conveyor 132 proceeds via an adapter hose 136 into the used toner container 84 in the normal operating condition. The conveyor 132 is driven by a drive 134. When a control of a coupling is inserted between this drive 134 and the conveyor 132, then the conveyor 132 can be at a standstill during the replacement of the used toner container 84. The used toner occurring during the replacement then remains in the conveying channel of the conveyor 132.

Another possibility is comprised in arranging a closure 138 at the level of the flexible adapter hose 136 that is actuated for replacing the used toner container. An intermediate container 142 can also be provided that takes place of the used toner container 84 when it is being replaced and collects the used toner. The operation of the controllable coupling, of the intermediate container 142 or of the closure 138 can be controlled via the micro-switch 122 that identifies when the drawer 110 has been withdrawn. Dependent on the signal of the micro-switch 122, the corresponding actuator elements can be activated.

What is claimed is:

1. Apparatus for electrographically producing image patterns on a recording medium, said apparatus comprising at least one printing unit, a toner reservoir being permanently installed with the apparatus for supplying toner to the unit and being refilled at chronological intervals via a filling opening, an apparatus cover for covering internal parts of the apparatus as well as the toner reservoir, electrical safety means that interrupts operation of the apparatus when the apparatus cover is opened, and a second opening being provided in the apparatus cover through which the toner reservoir can be refilled from the outside without interrupting the printing process, the improvement comprising means for generating a slight under-pressure in the toner reservoir, at least during the refilling procedure and said filling opening having a mouth adjacent the second opening for receiving a neck of a standardized toner bottle being inserted into said filling opening and second opening, so that a portion of the bottle remains outside of the apparatus cover during a filling operation.

2. An apparatus according to claim 1, wherein the mouth of the filling opening has an axis extending at an angle which is acute to the apparatus cover so that the toner bottle is at an acute angle to a horizontal plane during a filling operation.

3. Apparatus according to claim 1 wherein apparatus cover is fashioned as a lockable apparatus door; and wherein the second opening can be closed by a pivotable flap secured in the door.

4. Apparatus according to claim 3, wherein the flap has a horizontally proceeding swivelling axis around which the flap can be swivelled down by a predetermined angle.

5. Apparatus according to claim 3, wherein the flap is fashioned such that it forms a collecting container for spilled toner in the open condition.

6. Apparatus according to claim 3, wherein an opening for a control panel is situated in the apparatus door above the flap, said control panel being mounted to be swivelled-out of this opening; and wherein the filing opening of the toner reservoir is positioned so that, given refilling with a standardized toner bottle, the bottle can be introduced with play at the swivelled-out control panel.

7. Apparatus according to claim 1, wherein the apparatus is a high-performance printer with two printing units; and wherein a toner reservoir is provided per printing unit, and a pivotable flap in the apparatus door being respectively allocated to each reservoir.

8. Apparatus according claim 1, wherein the mouthpiece is releasably introduced into the opening.

9. Apparatus according to claim 8, wherein a closure cover provided with a handle is releasably introducable into the mouthpiece.

10. Apparatus according to claim 9, wherein the closure cover has a spring-loaded catch mechanism that engages into the mouthpiece with a snap-in event after the insertion of the closure.

11. Apparatus according to claim 8, wherein the mouthpiece has a funnel-shaped section so that an optimally small annular gap arises after the introduction of the bottle neck of the toner refilling bottle.

12. Apparatus according to claim 8, wherein a center axis of the opening of the mouthpiece approximately intersects a center axis of the reservoir within the upper half of the toner reservoir.

13. Apparatus according to claim 1, wherein the toner reservoir has an air discharge opening connected to means for extracting air.

14. Apparatus according to claim 13, wherein the air discharge opening has a filter that retains toner inside the toner reservoir.

15. Apparatus according to claim 13, wherein the air discharge opening lies in the upper region of the toner reservoir, preferably in the toner-free region.

16. Apparatus according to claim 1, wherein the toner filling level in the toner reservoir is acquired by a filling level sensor; in that, given downward transgression of a predetermined filling level, an alarm signal is generated; and wherein the refilling of the toner reservoir ensues dependent on this alarm signal without interrupting the printer or copier operation.

17. Apparatus according to claim 16, wherein a capacitative sensor is provided as a filling level sensor and is arranged displaceable in an axial direction on an outside wall of the toner reservoir for generating the alarm signal when the filling level in the toner reservoir reaches the sensor.

18. Apparatus according to claim 16, wherein control means carries out a check after the generation of the alarm signal to see whether a certain minimum quantity of toner is contained in the toner reservoir and with a given downward transgression of this minimum quantity, the control means generates an abort signal with which the printing unit operation is shut off.

19. Apparatus according to claim 1 which, includes elimination means for transfer of the used toner collected from a cleaning station to a used toner container, said elimination means can be interrupted in order to enable a replacement of the used toner container free of interruptions of the operation of the printing unit.

20. Apparatus according to claim 19, wherein the used toner collected from a cleaning unit in the apparatus is supplied by the elimination means to a used toner container via an adapter unit that contains a flexible hose.

21. Apparatus according to claim 20, the flexible hose has a material at its inside that is impenetrable for toner and repels toner; and in that it is preferably manufactured of silicone.

22. Apparatus according to wherein, the flexible hose expands frustum-shaped in the direction toward the used toner container.

23. Apparatus according to one of the claim 19, wherein the used toner container is accepted in a drawer seated in running rails, preferably telescoping rails.

24. Apparatus according to claim 23, wherein a locking plate has an end facing away from its pivot point moving up on a ramp upon compression of the flexible hose when the drawer is pulled out; and in that the locking plate engages behind a stop edge when the drawer is pushed in.

25. Apparatus according to claim 19, wherein a microswitch monitors the position of the drawer.

26. Apparatus according to claim 20, wherein a flow of the used toner from the cleaning station to the adapter unit can be interrupted in order to enable a replacement of the used toner container that is free of apparatus interruptions.

27. Apparatus according to claim 19, wherein a controllable coupling that can be actuated for replacing the used toner container free of printing interruptions is connected between a drive and a conveyor shaft (132) for toner removal from the cleaning station.

* * * * *

UNITED STATES PATENT AND TRADEMARK OFFICE

CERTIFICATE OF CORRECTION

PATENT NO. : 6,229,975 B1
DATED : May 8, 2001
INVENTOR(S) : Wilhelm et al.

It is certified that error appears in the above-identified patent and that said Letters Patent is hereby corrected as shown below:

Column 3,
Line 20, after “printer” insert -- 10 when either of the doors 12a --.

Column 4,
Line 42, after “slight” insert -- under-pressure --.

Column 6,
Line 22, replace “explainding” with -- expanding --.

Column 7,
Lines 44 and 45, replace “20A, left” with -- 20A --.

Column 9,
Line 3, replace “procedure” with -- procedure, --;
Line 14, after “wherein” insert -- the --;
Line 38, before “opening” insert -- filling --.

Column 10,
Line 34, after “20,” insert -- wherein --;
Line 37, replace “wherein,” with -- claim 20, wherein --.

Signed and Sealed this

Fourteenth Day of February, 2006

JON W. DUDAS
*Director of the United States Patent and Trademark Office*